US007670018B2

(12) United States Patent
Kim et al.

(10) Patent No.: US 7,670,018 B2
(45) Date of Patent: Mar. 2, 2010

(54) ILLUMINATION DEVICE FOR REFRIGERATOR AND METHOD OF CONTROLLING THE SAME

(75) Inventors: Jun Beom Kim, Changwon (KR); Dae Kil Kang, Changwon (KR); Sang Hyun Cheon, Changwon (KR); Sung Tae No, Changwon (KR); Sun Kook Ji, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/747,439

(22) Filed: May 11, 2007

(65) Prior Publication Data

US 2007/0268682 A1 Nov. 22, 2007

(30) Foreign Application Priority Data

| | | |
|---|---|---|
| May 16, 2006 | (KR) | 10-2006-0043932 |
| May 23, 2006 | (KR) | 10-2006-0046233 |
| May 30, 2006 | (KR) | 10-2006-0048488 |
| Jun. 23, 2006 | (KR) | 10-2006-0056628 |
| Jun. 29, 2006 | (KR) | 10-2006-0059166 |
| Sep. 6, 2006 | (KR) | 10-2006-0085925 |

(51) Int. Cl.
*F21V 33/00* (2006.01)

(52) U.S. Cl. ..... 362/92; 362/267; 62/127; 62/150; 62/264

(58) Field of Classification Search ..... 362/92, 362/94, 154, 155, 240, 241, 247, 267, 362, 362/374, 375, 96, 133, 158; 312/401, 406, 312/223.5; 62/264, 127, 150
See application file for complete search history.

(56) References Cited

U.S. PATENT DOCUMENTS 5,458,186 A 10/1995 Lee et al.

(Continued)

FOREIGN PATENT DOCUMENTS

JP 07-270044 10/1995

(Continued)

OTHER PUBLICATIONS

English Translation of Abstact, Specification, and Claims of Korean Publication KR 2006007615 A.*

(Continued)

*Primary Examiner*—Anabel Ton
*Assistant Examiner*—Kevin Spinella
(74) *Attorney, Agent, or Firm*—Ked & Associates, LLP

(57) ABSTRACT

An illumination device for a refrigerator and a method of controlling the same are provided. The illumination device includes a lamp assembly that irradiates light to an inside of a storage chamber of the refrigerator, a base plate mounted on a side within the storage chamber, wherein the lamp assembly is provided on a side of the base plate, a watertight cover formed to enclose the lamp assembly blocking direct penetration of water into the lamp assembly, and at least one fastening device formed on a side of the base plate. The at least one fastening device surrounds an outer surface and an inner surface of entire lower edge of the watertight cover along a side of the watertight cover forming a recess-prominence engagement with the watertight cover. Lamps provided in the lamp assembly are individually controlled through a manipulation panel mounted on the main body.

18 Claims, 15 Drawing Sheets

U.S. PATENT DOCUMENTS

| | | | | |
|---|---|---|---|---|
| 5,516,390 | A * | 5/1996 | Tomita et al. | 156/108 |
| 6,340,236 | B1 * | 1/2002 | Hisanaga | 362/267 |
| 7,210,808 | B2 * | 5/2007 | Malpetti | 362/92 |
| 2002/0051357 | A1 * | 5/2002 | Truttmann-Battig | 362/92 |
| 2005/0178131 | A1 | 8/2005 | Ryu et al. | |
| 2006/0201181 | A1 | 9/2006 | Bauer et al. | |
| 2007/0104841 | A1 | 5/2007 | Min et al. | |
| 2008/0307818 | A1 | 12/2008 | Min et al. | |

FOREIGN PATENT DOCUMENTS

| | | | |
|---|---|---|---|
| JP | 2003-343971 | | 12/2003 |
| JP | 2005-065622 | | 3/2005 |
| KR | 10-1999-025753 | | 4/1999 |
| KR | 20-0312800 | | 5/2003 |
| KR | 10-2006-0007615 | A | 1/2006 |
| KR | 2006007615 | A * | 1/2006 |
| WO | WO 2005/024323 | | 3/2005 |

OTHER PUBLICATIONS

English translation of JP 2005-065622.

* cited by examiner

ILLUMINATION DEVICE FOR REFRIGERATOR AND METHOD OF CONTROLLING THE SAME

BACKGROUND OF THE INVENTION

1. Field of the Invention

The present invention relates to a refrigerator, and more particularly to an illumination device for a refrigerator, which illuminates a storage chamber forming the interior of the refrigerator and includes a lamp adapted to be turned on or off depending on the opening or closing of the door of the refrigerator, and a method of controlling the same.

2. Description of the Prior Art

In general, refrigerators are appliances fabricated for the purpose of storing food at a low temperature, wherein such refrigerators are configured so that one or more storage chambers provided within the refrigerators can be cooled by a refrigeration cycle implemented by a plurality of electric components and circulating working fluid.

Such refrigerators tend to get larger in size, and to be multi-functionalized and diversified in construction due to the change of living environment. According to this tendency, various refrigerators, including kimchi refrigerators, are developed.

In addition, a technology of irradiating various colored lights to one or more products stored in the storage chamber have been developed and are applied, wherein light emitting diodes so called LEDs are frequently employed so as to irradiate various colored lights within storage spaces as described above.

Now, a lidded kimchi refrigerator will be described by way of an example for the purpose of convenience in description and understanding. However, it is natural that the present invention can be variously applied regardless of the type of a refrigerator.

A typical lidded kimchi refrigerator: includes a main body provided with a storage chamber which is upwardly opened so as to introduce one or more products to be stored, such as kimchi, into the storage chamber; a door rotatably connected at a side of the opening of the main body so as to selectively shield the storage chamber; and a lamp assembly mounted on the bottom surface of the door for irradiating light to the interior of the storage chamber.

However, the kimchi refrigerator configured as described above has the following problems.

Because the lamp assembly is mounted on the bottom surface of the door, there is a problem in that moisture or water may be directly penetrated into the lamp assembly due to user's carelessness when food is introduced into the storage chamber. Like this, if moisture or water is penetrated into the lamp assembly, there is a problem in that one or more lamps and/or power devices provided within the lamp assembly come into contact with the moisture or water, thereby causing the lamp assembly to be fractured, which may injure the user.

Occasionally, the lamp assembly may continuously illuminate the storage chamber or entirely illuminate the entire storage chamber regardless of the used area of the storage chamber. As a result, there is a problem in that power is unnecessarily consumed due to the lamp assembly.

SUMMARY OF THE INVENTION

Accordingly, the present invention has been made to solve the above-mentioned problems occurring in the prior art, and the present invention provides an illumination device for a refrigerator, which has a function for blocking moisture or water infiltrating into the lamp assembly, and a method of controlling the same.

In addition, the present invention provides an illumination device for a refrigerator which can minimize power consumed when a storage chamber of the refrigerator is illuminated, and a method of controlling the same.

Several preferred embodiments of the present invention will be described in more detail below with reference to accompanying drawings, from which the characteristics and advantages of the present invention will become more apparent.

BRIEF DESCRIPTION OF THE DRAWINGS

The above and other objects, features and advantages of the present invention will be more apparent after reading the following detailed description taken in conjunction with the accompanying drawings, in which.

DETAILED DESCRIPTION OF THE PREFERRED EMBODIMENTS

Figure 1:
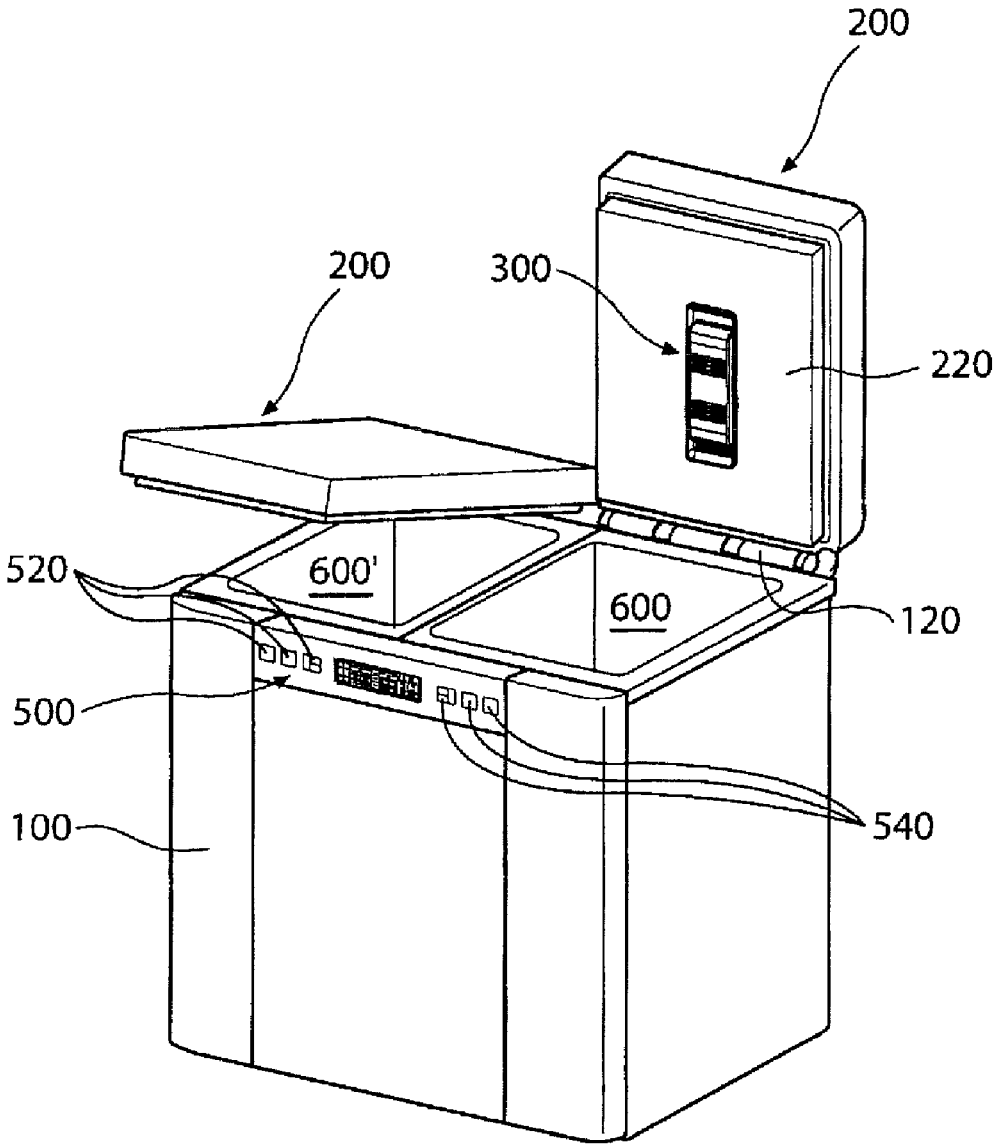
FIG. 1 is a perspective view showing an external appearance of a refrigerator, in which the inventive refrigerator illumination device is employed.

Hereinafter, a preferred embodiment of the present invention will be described in more detail with reference to the accompanying drawings. In the following description and drawings, the same reference numerals are used to designate the same or similar components.

FIG. 1 is a perspective view showing an external appearance of a refrigerator which employs the inventive illumination device for a refrigerator.

Referring to FIG. 1, the inventive kimchi refrigerator includes: a main body 100 forming the appearance of the refrigerator and provided with at least one storage chamber 600, the storage chamber 600 being opened at the top thereof so that products to be stored, such as kimchi, can be introduced into the storage chamber 600; at least one door 200 rotatably connected to a side of the opening in the main body 100 through a hinge 120 so as to selectively close the storage chamber 600, the door 200 being formed with a door liner 220 on the bottom side thereof; a lamp assembly 300 mounted on the bottom side of the door 200 50 as to irradiate light to the interior of the storage chamber 600; and a manipulation panel 500 for controlling the lamp assembly 300, the manipulation panel 500 being formed at the central top area of the front face of the main body 100.

A first embodiment of the inventive lamp assembly for a refrigerator will be firstly described.

Figure 2:
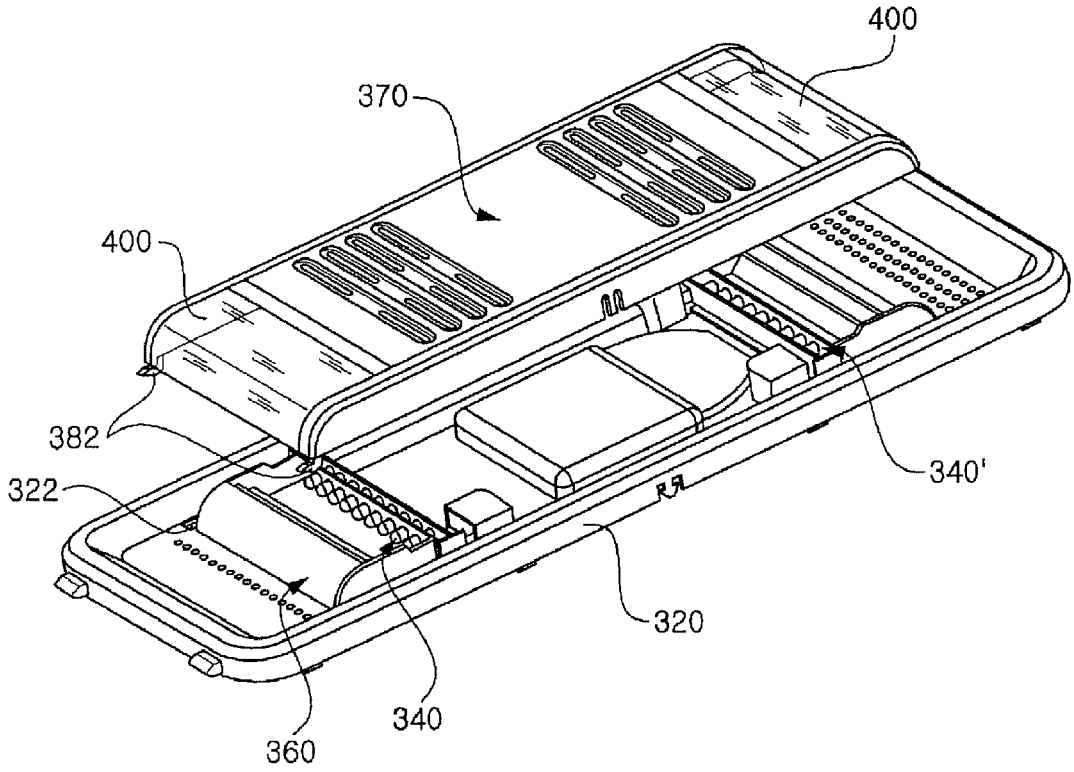
FIG. 2 is an exploded perspective view showing the construction of a lamp assembly, which is a main component of the inventive refrigerator illumination device.
Figure 3:
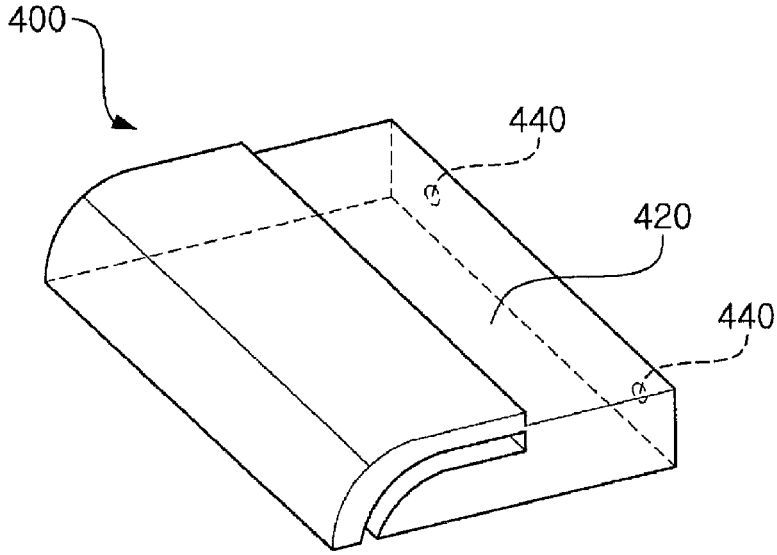
FIG. 3 is a perspective view showing an external appearance of a watertight cover which configures an embodiment of the present invention.
Figure 4A:
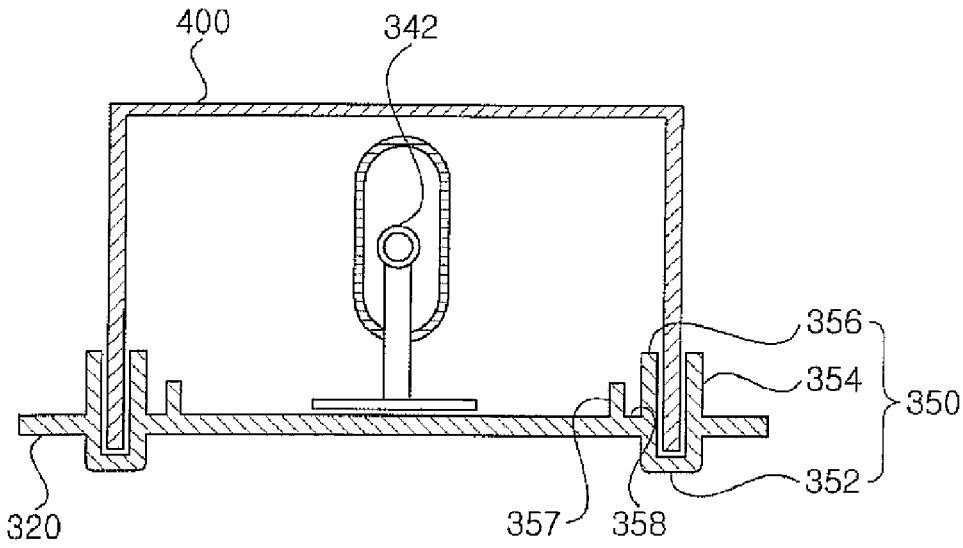
FIG. 4*a* is a cross-sectional view showing the watertight cover in the mounted state.
Figure 5:
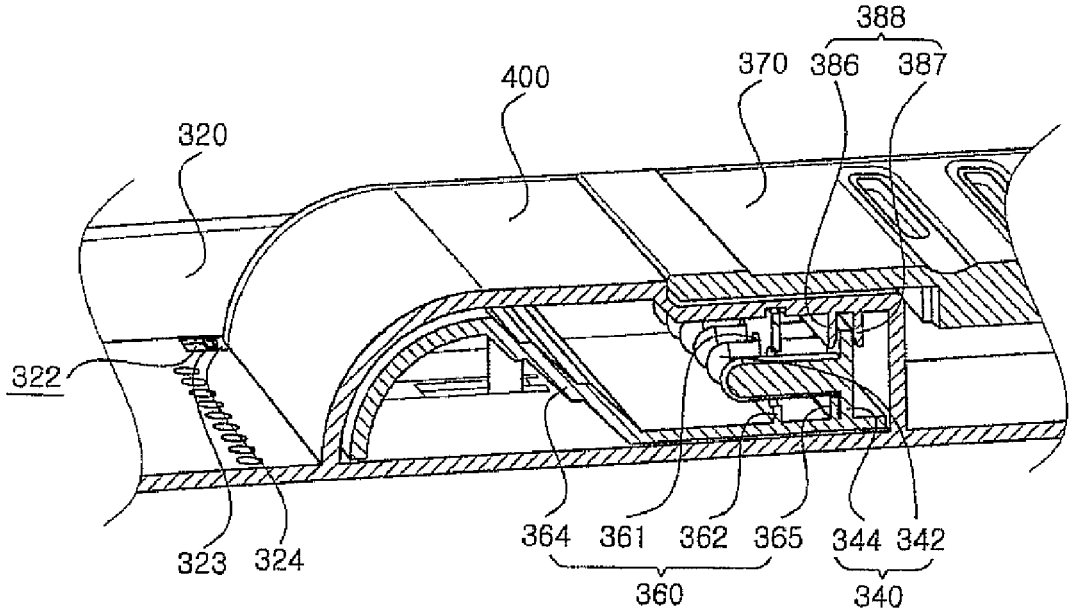
FIG. 5 is a partially cutaway perspective view showing the inventive lamp assembly.
Figure 4B:
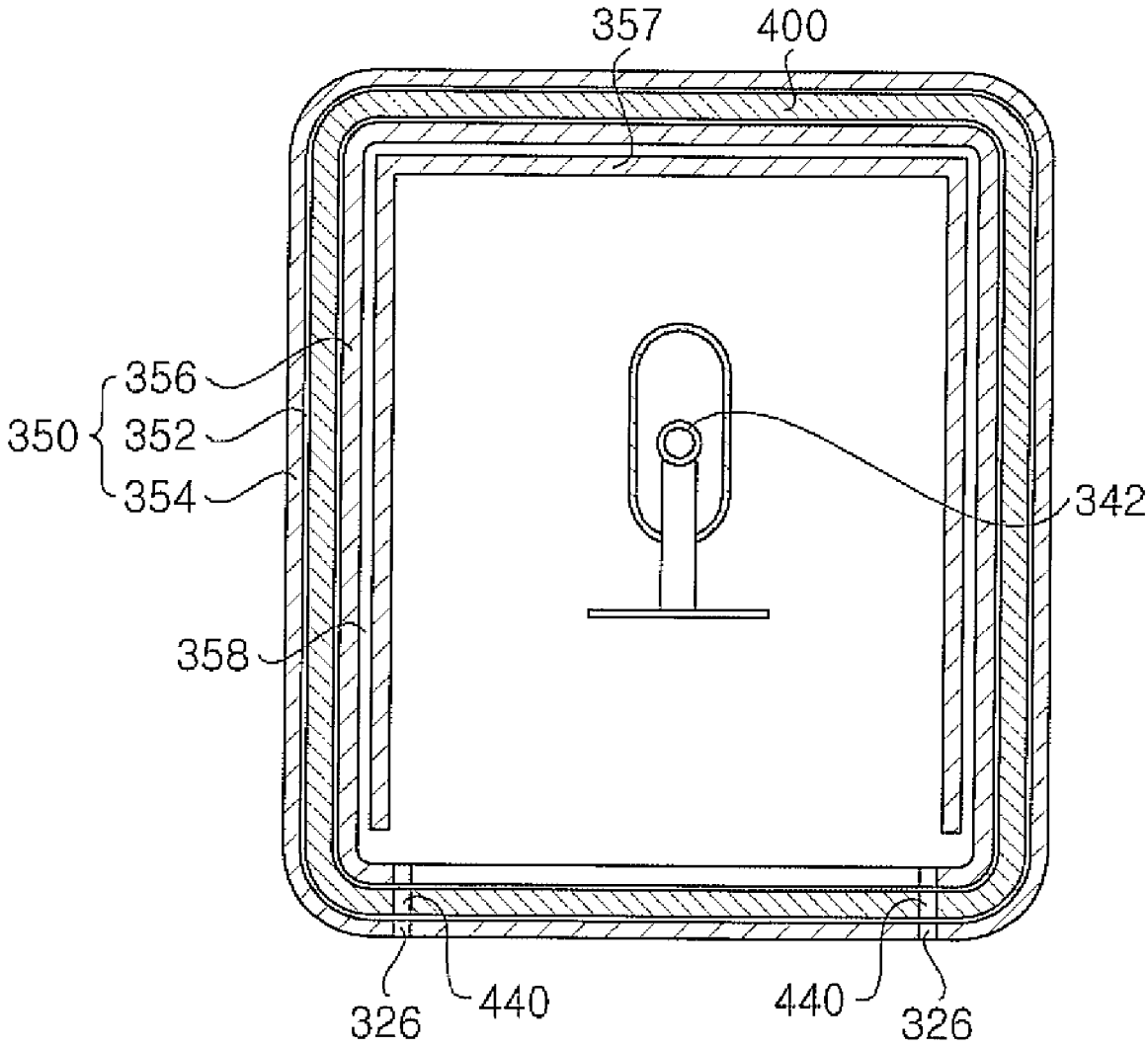
FIG. 4*b* is a schematic view showing the watertight cover in the mounted state.

FIG. 2 is an exploded perspective view showing the construction of a lamp assembly, which is a main component of the inventive illumination device, FIG. 3 is a perspective view showing an external appearance of a watertight cover which configures an embodiment of the present invention, FIG. 4*a* is a cross-sectional view showing the watertight cover in the mounted state, FIG. 4*b* is a schematic view showing the water tight cover in the mounted state, and FIG. 5 is a partially cutaway perspective view showing the inventive lamp assembly.

Referring to these drawings, the lamp assembly 300 includes: a lamp mounting unit 360 mounted on the door liner 220 of the door 200; at least one lamp 340 mounted on a side of the lamp mounting unit 360 so as to irradiate light when power is applied to the lamp 340; and a lamp cover 370 for shielding the top of the lamp 340 so as to protect the lamp 340 from external moisture or water, the lamp cover 370 being engaged with the lamp mounting unit 360.

Figure 6A:
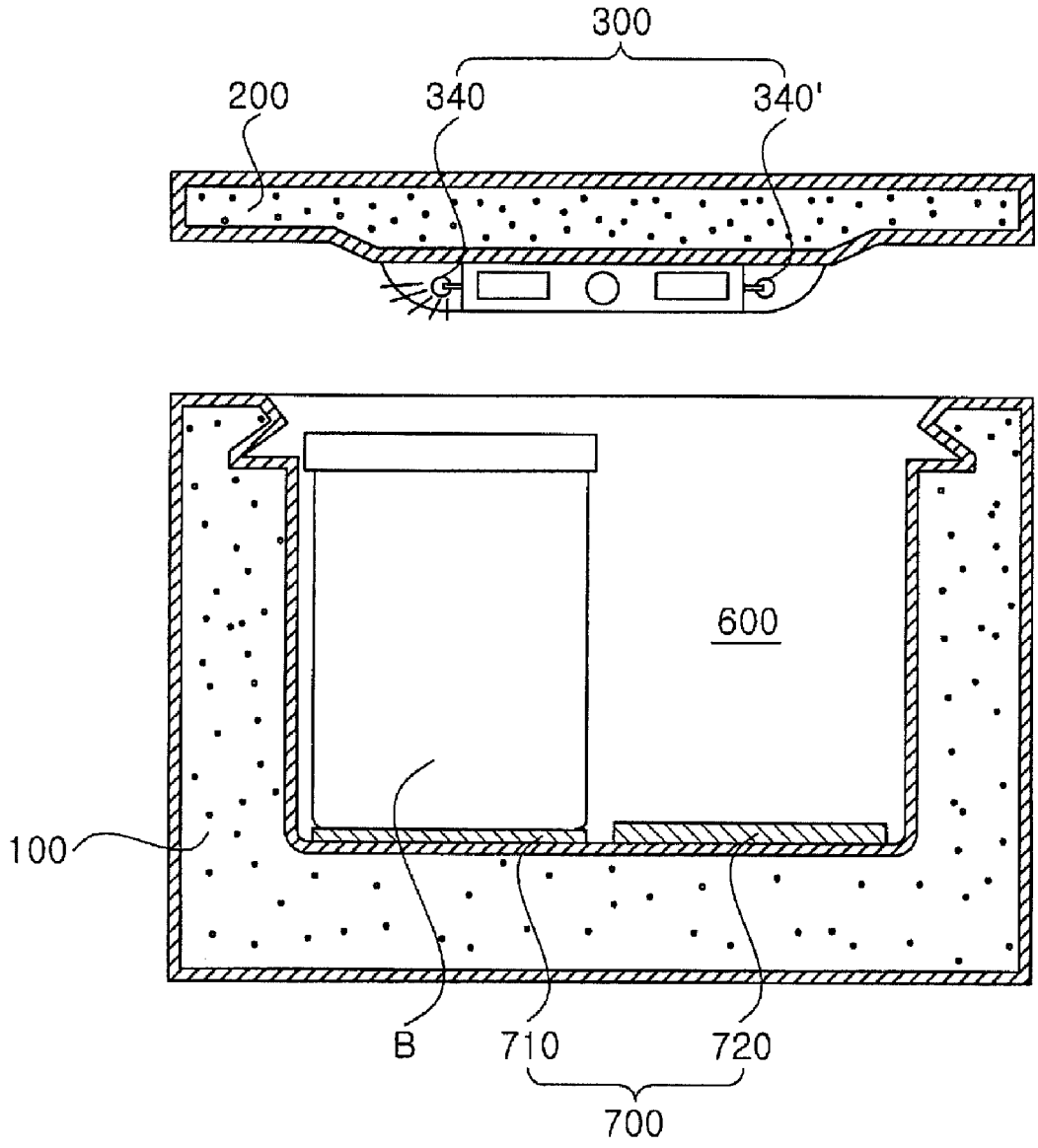
FIG. 6*a* to 6*c* are cross-sectional views showing other embodiments of the inventive refrigerator illumination device.
Figure 6B:
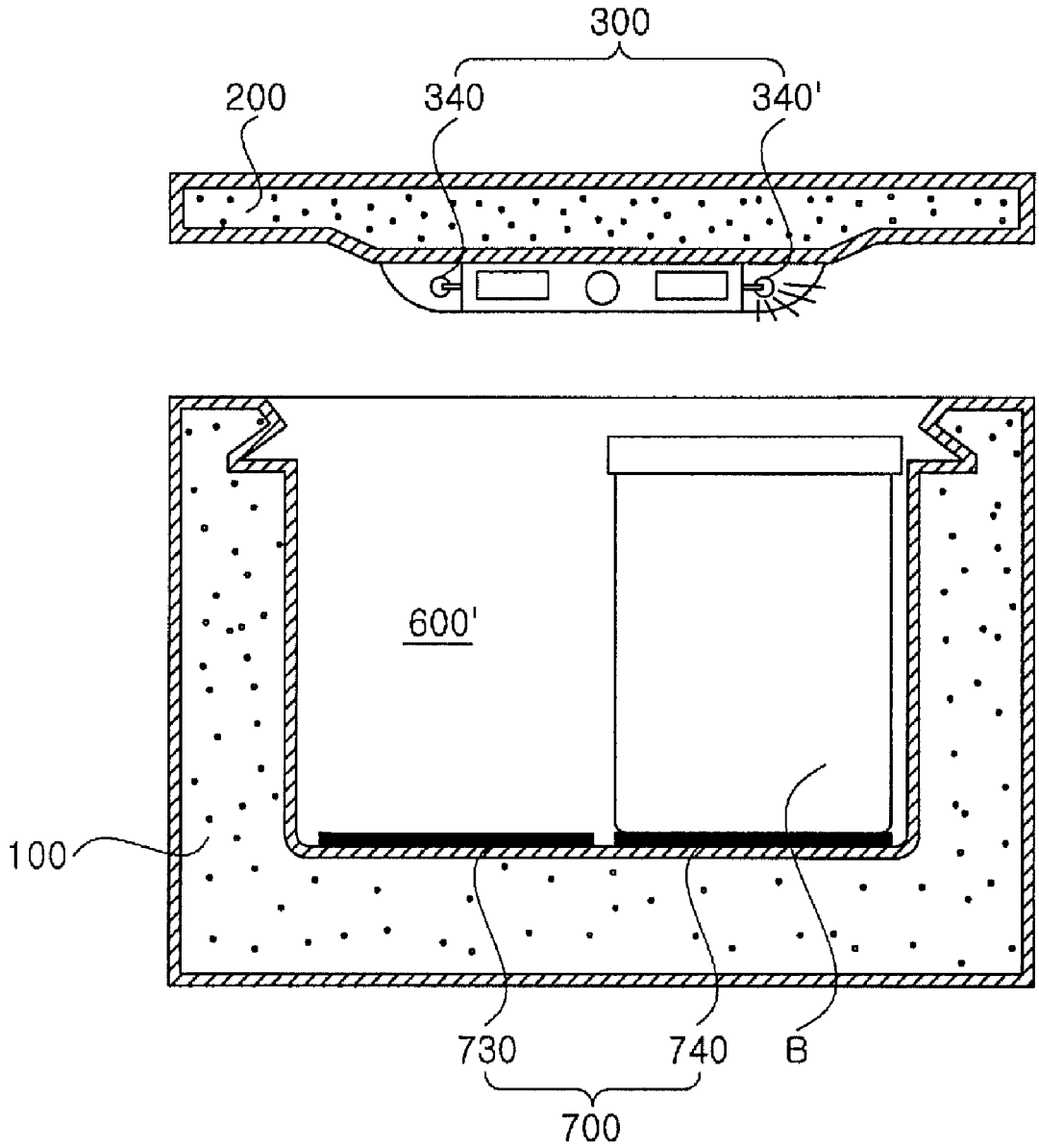
Figure 6C:
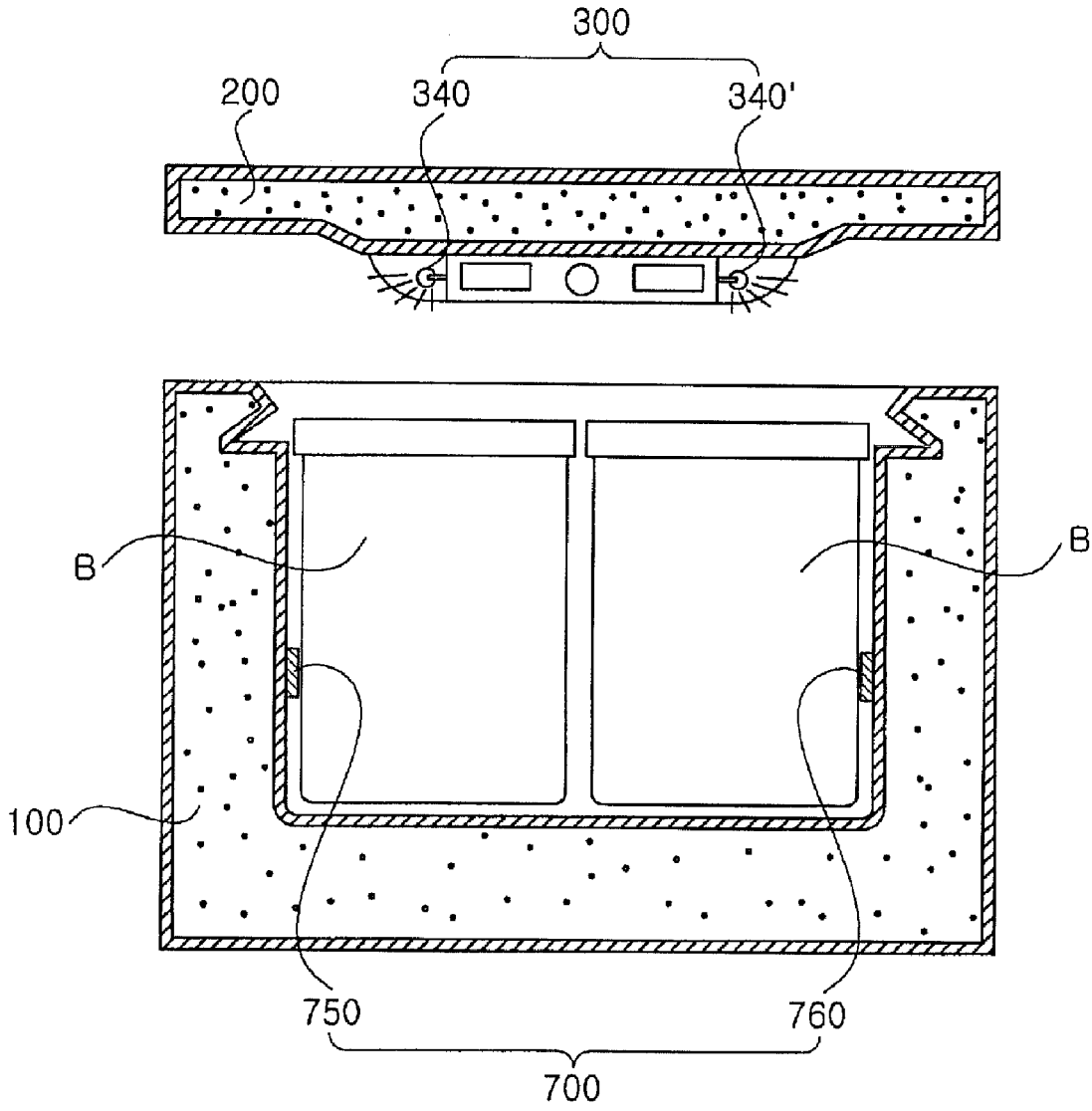

The lamp 340 includes a plurality of light emitting diodes 342 for emitting white, blue and yellow lights, and a substrate 344, on which the light emitting diodes 342 are mounted, wherein the lamp 340 is fixed in position by the lamp mounting unit 360 and the lamp cover 370, which will be described in detail below, thereby forming stable light paths. Here, a lamp positioned right when viewed in FIG. 6*a*-6*c* is denoted by reference numeral 340'. Herein below, the lamps 340 and 340' will be separately described as a first lamp 340 and a second lamp 340' as needed.

The substrate 344 has a power circuit for operating the light emitting diodes 342 electrically connected with the manipulation panel 500 through a print circuit board (PCB).

The lamp mounting unit 360 includes: a base plate 320 forming the bottom of the lamp mounting unit 360; a diode holder 362 projecting upward from the right side of the base plate 320, the diode holder 362 being formed with holes in a size corresponding to that of the light emitting diodes 342 so as to provide spaces for fitting the light emitting diodes 342; and a front guide projection 365 projecting upward at the left side of the diode holder 362 so as to guide the forward insertion of the lamp 340.

In addition, on the left side of the lamp mounting unit 360, more specifically, at the left side of the lamp 340, there is provided a reflection plate 364 for scattering light irradiated from the light emitting diodes 342 to the interior of the storage chamber 600.

In addition, on the left side of the lamp mounting unit 370, more specifically, at the left side of the lamp 340, there is provided a reflection plate 364 for scattering light irradiated from the light emitting diodes 342 to the interior of the storage chamber 600.

The base plate 320 is formed substantially in a rectangular shape, wherein a rim projecting upward is formed along the peripheral edges thereof so that the rim surrounds the inner area of the base plate 320. Although not shown in the drawings, there are provided insertion grooves at the left and right sides of the rear part of the top surface of the base plate 320, the rear end of the lamp cover 370 being inserted into the grooves. In addition, on the front part of the top surface of the base plate 320, there are provided guide slots 322 formed by piercing predetermined portions in the longitudinal direction of the base plate 320.

Because the diode holder 362 is formed with diode insertion holes 361, wherein each diode insertion hole 361 has a size corresponding to that of each light emitting diode 342, so that the fixed diodes 342 are anchored in the diode insertion holes 361, respectively. In addition, the front guide projection 365 is formed in a height lower than the mounting height of the light emitting diodes 342 so that the front guide projection 365 is in touch with the substrate 344 of the lamp 340 but is not in touch with the light emitting diodes 342.

The reflection plate 364 is provided so as to render the light irradiated from the diodes 342 to be scattered around the interior of the storage chamber 600. For this purpose, the reflection plate 364 is formed in a stair-like shape, the height of which increases as approaching the left edge thereof (as viewed in FIG. 5), and each surface between two adjacent steps is inclined to be oriented leftward upward (as viewed in FIG. 5).

The guide slots 322 are formed so as to allow couplers 324 (see FIG. 5) to be inserted into the guide slots 322, respectively wherein each of the guide slots 322 has a width slightly larger than that of each of the couplers 324 and is formed in a step-like shape in such a manner that the top side thereof inwardly projects slightly farther than the bottom side thereof, thereby providing a space in which the coupler 324 is settled.

Meanwhile, the lamp cover 370 is formed substantially in a rectangular parallelepiped shape, the bottom of which is opened and the left and right top edges of which are rounded. The lamp cover 370 is seated on the top of the base plate 320. In addition, the lamp cover 370 has a central area formed from an opaque material and outer areas formed from a transparent material. Further, the lamp cover 370 is additionally formed with fixing ribs 388 projecting downward from the right area (as viewed in FIG. 5) of the inner surface thereof. The above description has been made on the basis of the construction shown in FIG. 5. However, the right area of the lamp cover 370 with reference to the center of the lamp cover 370 not shown in FIG. 5 has the same configuration as the left area shown in FIG. 5. The description below will be also made with reference to FIG. 5.

The fixing ribs 388 are provided so as to restrain the substrate 344, thereby preventing the lamp 340 from moving leftward or rightward (as viewed in FIG. 5), wherein the fixing ribs 388 includes a front fixing rib 386 formed in front of the substrate 344 so as to prevent the lamp 340 from moving left (as viewed FIG. 5) beyond a predetermined position, and a rear fixing rib 387 spaced from the front fixing rib 386 by the thickness of the substrate 344 so as to prevent the lamp 340 from being released to the rear side.

In addition, the lamp cover 370 is further formed with hooks 382 at the bottom edge of the left side thereof.

The hooks 382 are inserted into the guide slots 322 formed in the base plate 320 and anchored by the couplers 324, respectively, wherein each of the hooks 382 is formed by forwardly bending a downwardly extending projection substantially in a "]" shape, so that the bent portion is restrained by a corresponding coupler 324, whereby the lamp cover 370 is assembled to the base plate 320.

Each of the coupler 324 is formed in a width slightly smaller than that of the corresponding guide slot 322 so that the coupler 324 can be inserted into the guide slot 322. Although not shown in the drawings, a projection is formed on the top area of a side surface of the coupler 324, wherein the projection comes into contact with the lower end of the step-like part of the guide slot 322 so that the coupler 324 can be inserted into and settled in the guide slot 322.

In addition, a coupler handle 323 is formed on the top of each of the couplers 324 so as to allow a user to easily grasp the couplers 324, and a hook engaging portion (not shown) is formed at the right of the coupler handle 323 (as viewed in FIG. 5) in a shape corresponding to the shape of the corresponding hook 382 so that the hook 382 is engaged with the hook engaging portion.

Above the lamp 340, there is provided a watertight cover 400 formed from a transparent material so that the watertight cover 400 encloses the lamp 340, wherein the watertight cover 400 is assembled to the base plate 320. The watertight cover 400 is formed substantially in a rectangular hexahedron box shape, wherein the bottom of the cover 400 is opened, and the edge between the top surface and front surface of the cover 400 is rounded. In addition, the opposite sides of the watertight cover 400 are formed with grooves extending along the rounded shape, and the top surface of the watertight cover 400 is formed in a step-like shape, thereby providing a lower step part 420.

The lower step part 420 is pressed by a cover 370 to be described later, so that the upward release of the watertight cover 400 can be prevented. In addition, the watertight cover 400 is formed with water discharge openings 440 through the rear wall thereof, wherein the water discharge openings 440 are formed and positioned to correspond in size to water discharge holes 326 to be described later, respectively. After the watertight cover 400 is assembled, it is positioned to correspond to the water discharge holes 326.

Now, the construction for assembling the watertight cover 400 and the base plate 320 will be described with reference to the drawings.

The base plate 320 is formed with fastening means 350, which has a shape complementarily corresponding to the lower edge of the watertight cover 400, so that the lower edge of watertight cover 400 can be fitted in the fastening means 350.

The fastening means 350 includes a first rib 354 extending along the outer surface of the lower edge of the watertight cover 400, thereby entirely surrounding the outer surface of the lower edge of the watertight cover 400, a second rib 356 extending along the inner surface of the lower edge of the watertight cover 400, thereby entirely surrounding the inner surface of the lower edge of the watertight cover 400, and a central groove 352 formed between the first and second ribs 354 and 356.

That is, since the first and second ribs 354 and 356 project upward, the central groove 352 is formed between the first and second ribs 354 and 356, and the lower edge of the watertight cover 400 is inserted into the central groove 352.

It will be desirable that the central groove 352 is formed more deeply by recessing the base plate 320 so that the lower edge of watertight cover 400 can be more rigidly fitted in the central groove 352.

Meanwhile, the fastening means 350 and the lower edge of the watertight cover 400 form a complementary recess-prominence engagement, thereby preventing moisture or water from directly penetrating into the lamp 340.

The lamp 340 further includes a water discharge rib 357. Such water discharge rib 357 is provided so that moisture passing through the recess-prominence engagement condenses on the water discharge rib 357, thereby forming water droplets, wherein the water discharge rib 357 forms a rim spaced from the second rib 356. Therefore, a space is formed between the second rib 356 and the water discharge rib 357, wherein such a space forms a water discharge channel 358, so that water droplets condensing on the water discharge rib 357 are guided downward, thereby flowing into the water discharge channel 358.

The water flowing downward along the water discharge channel 358 is discharged through the water discharge holes 326 formed through the fastening means 350 and the water discharge openings 440 formed through the watertight cover 400, wherein the water discharge holes 326 and the water discharge openings 440 are in conformity with each other.

Meanwhile, a first set of buttons 520 provided left with reference to the center of the manipulating panel 500 control the first lamp 340 for irradiating light to the left storage chamber 600' (see FIG. 1), and a second set of buttons provided right controls the second lamp 340' for irradiating light to the right storage chamber 600 (see FIG. 1). Although not shown in the drawings, the buttons 520 and 540 are provided with elastic members, such as springs, and fastening means, such as hooks, within the inside thereof. Each of the buttons 520 and 540 is configured like an ordinarily used push button in the following manner: upon being pressed an odd number of times, they connect the power circuit to a power source so that power is supplied to the power circuit, and upon being pressed an even number of times, they cut off the connection of the power circuit to the power source so that power supply to the power circuit is interrupted.

In order to irradiate light to each of the storage chambers 600 and 600', the lamps 340 and 340' should be installed to be oppositely oriented with reference to the center of the lamp assembly 300.

A reflection layer 122 is formed on an inner case forming the internal wall of the main body 100. The reflection layer 122 reflects visible rays irradiated from the lamp assembly 300, so that the visible rays are uniformly distributed in the entire storage chamber 600.

In addition, a door reflection layer 240 is formed on the inner surface of the door 200 by coating the same material as the reflection layer 122. The door reflection layer 240 reflects the visible rays irradiated from the lamp assembly 300 and then reflected from the reflection layer 122 toward the door 200, so that the visible rays are directed toward the storage chamber 600, whereby the door reflection layer 240 serves to render more visible rays to be irradiated to the storage chamber 600.

Now, the functional action of the first embodiment of the present invention will be described in detail.

The lamp assembly 300 mounted on the bottom 220 of the door 200 receives the lamp 340 so as to irradiate light into the storage chamber 600. Therefore, it is necessary to fixedly install the lamp 340 so that a light path can be stably maintained without being shaken even if the door is pivoted.

For the above-mentioned reason, the lamp 340 is fixed to the base plate 320, wherein the light emitting diodes 342 are fixed in the lamp mounting unit 360 by being inserted into the lamp mounting unit 360 from the rear side of the lamp mounting unit 360. That is, by inserting the light emitting diodes 342 into the diode insertion holes 361, which correspond in size to the light emitting diodes 342, respectively, until the substrate 344 comes into contact with the front guide projection 365, the mounting positions of the light emitting diodes 342 are fixed by the diode holder 362.

If the light emitting diodes 342 are inserted into the diode holder 362, the top of the lamp 340 is shielded by the lamp cover 370. At this time, the substrate 344 connected with the light emitting diodes 342 are fixed by the fixing ribs 388 projecting downward within the lamp cover 370, whereby the lamp 340 is mounted at a fixed position in the base plate 320, thereby stably maintaining the light path.

Meanwhile, the light irradiated by the lamp 340, i.e. by the light emitting diodes 342 while the light path is stably maintained is scattered into the storage chamber 600 by the reflection plate 364 through the lamp cover 370.

If the lamp 340 is mounted in the lamp mounting unit 360, the top of the lamp mounting unit 360 is shielded by the lamp cover 370, whereby the lamp received in the lamp mounting unit 360 is protected from external moisture or water. In addition, the lamp cover 370 is partially formed from a material of good transparency, thereby easily permitting light irradiated from the lamp to be transmitted to the inside of the storage chamber 600.

The lamp mounting unit 360 is mounted on the base plate 320.

More specifically, the rear end of the lamp cover 370 is inserted into an insertion groove (not shown) formed on the rear part of the base plate 320, and then the front end of the lamp cover 370 is lowered so that the hooks 382 are inserted into the guide slots 322 formed on the front part of the base plate 320.

Then, if the coupler handles 323 are moved forward, the couplers 324 are moved forward, so that the hooks 382 and the hook engaging portions (not shown) are engaged with each other. As a result, the front part of the lamp cover 370 is fixed, so that the lamp cover 370 is fixedly mounted on the base plate 320.

By this, the lamp 340 restrained by the lamp cover 370 is fixed, so that the lamp 340 can be easily installed without using separate anchoring elements, such as screws.

In addition, the lamp 340, which can be easily fractured by moisture or water, are fitted in the lamp mounting unit 360 in such a manner that the watertight cover 400 encloses the lamp 340, and the step-like part 420 is restrained by the cover 370, thereby preventing the watertight cover 400 from being upwardly released.

The watertight cover 400 fixed as described above blocks the direct or indirect penetration of moisture or water. The watertight cover 400 is formed from a transparent material, thereby allowing the light of the lamp to be transmitted to the outside without being blocked.

In addition, the watertight cover 400 forms a recess-prominence engagement with the lamp mounting unit 360, moisture penetrating into the lamp 340 can be blocked by the recess-prominence engagement. That is, the moisture penetrating into the inner side of the watertight cover 400, i.e. into the inner side of the lamp 340 forms water droplets while passing through the recess-prominence engagement, thereby being blocked by the recess-prominence engagement.

A part of the moisture, which has passed through the recess-prominence engagement, comes into contact with the water discharge rib 357 projecting within the lamp 340 and condenses on the water discharge rib 357, thereby forming water droplets. The water droplets formed in this manner flow downward along the water discharge channel 358 formed by the lamp mounting unit 360 and the water discharge rib 357, and then the water is discharged through a passage formed by the water discharge openings 440.

The user introduces products to be stored B into the storage chamber 600' and closes the top of the storage chamber 600' by the door 200. Then, the user presses the first set of buttons 520, so that the lamp 340 positioned left (as viewed in FIG. 2) is lighted. Therefore, the light is continuously irradiated only to the stored products B. Likewise, if the stored products B are received in the storage chamber 600, the user presses the second set of buttons 540, so that only the lamp 340 positioned right (as viewed in FIG. 2) is lighted.

If each of the storage chambers 600 and 600' contains stored products B, it is natural that all of the buttons 520 and 540 should be pressed thereby being lighted. Therefore, because it is not required to irradiate light to the interior of the storage chamber 600 unless products B are contained in the storage chamber 600, it is possible to prevent power from being unnecessarily consumed.

Figure 7A:
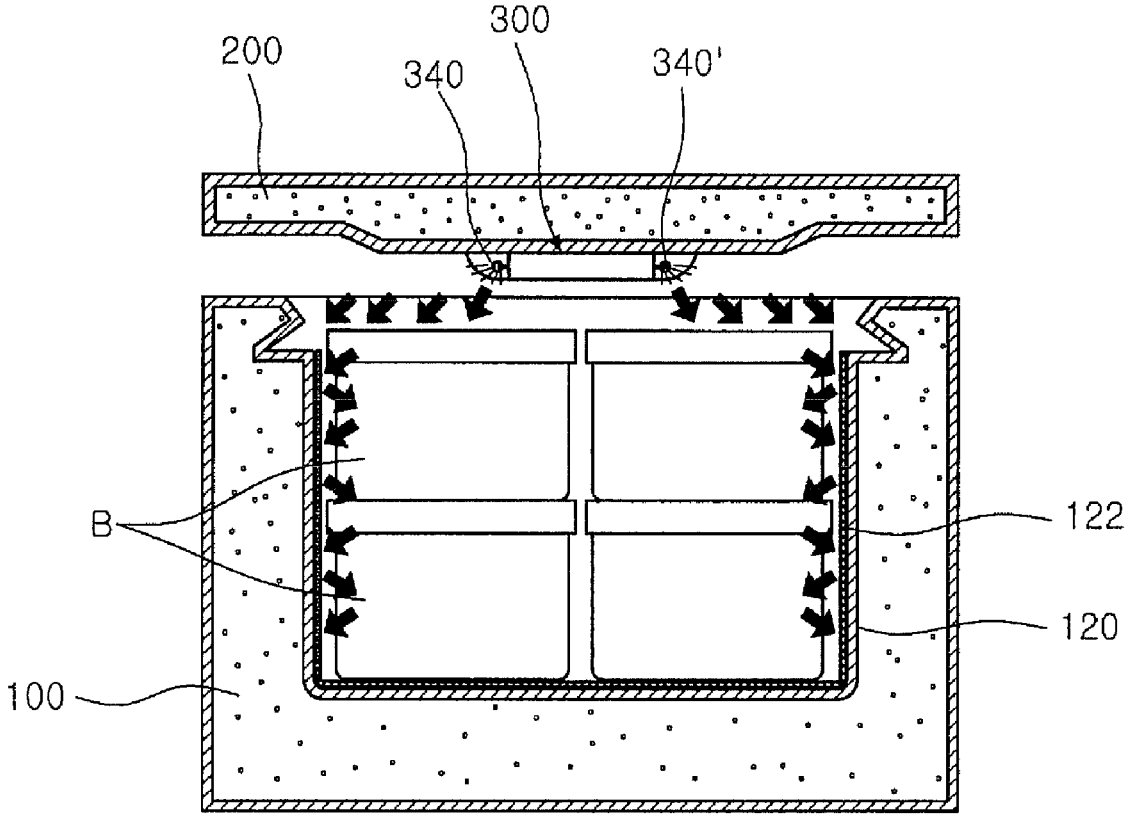
FIG. 7*a* and 7*b* are cross-sectional views showing the inventive refrigerator illumination device while being operated.
Figure 7B:
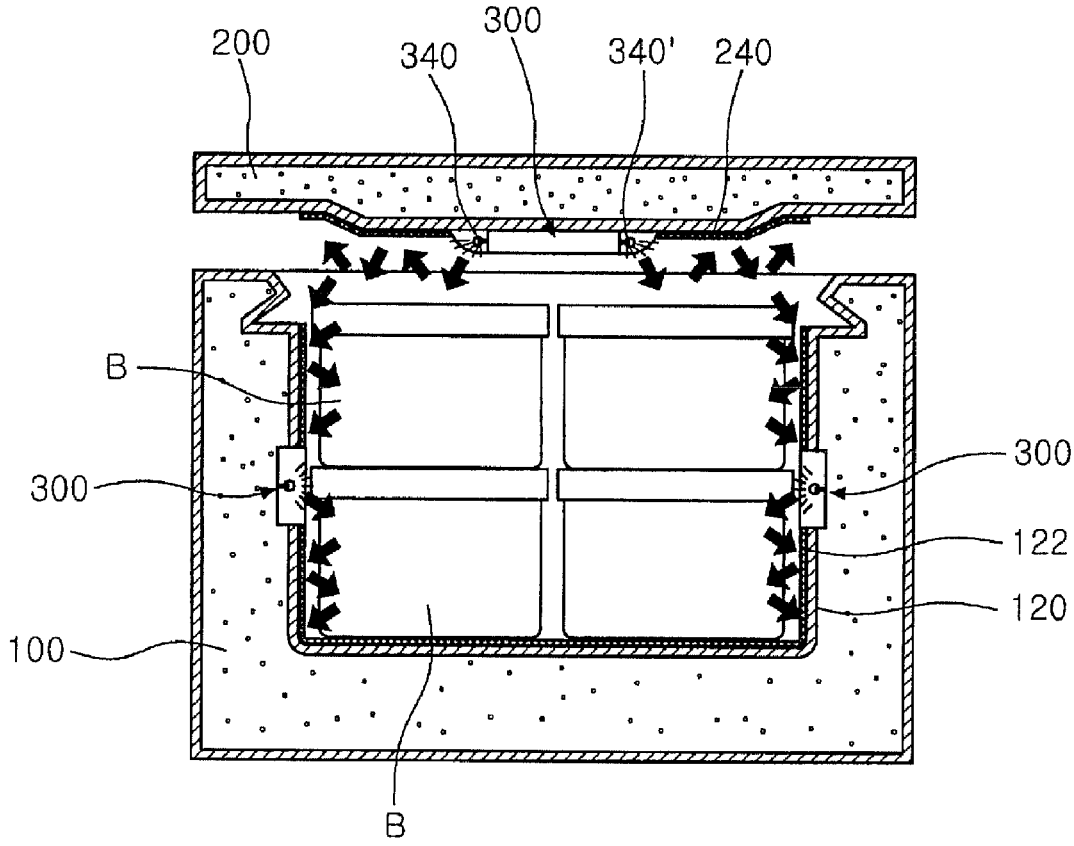

As can be seen from FIGS. 7*a* and 7*b*, products B to be stored are received within the storage chamber 600, the door 200 is closed, and then refrigeration cycle is activated in the main body 100, so that the interior of the storage chamber 600 is cooled.

At this time, in order to store food in a desired condition, the user adjusts the activation of the refrigeration cycle so as to control the temperature within the storage chamber 600, and operates the lamp assembly 300 so as to irradiate visible rays to the interior of the storage chamber 600. Of course, the lamp assembly 300 may be provided on a side wall of the storage chamber 300 so as to irradiate visible rays.

Next, the second embodiment of the inventive lamp assembly for a refrigerator will be described.

The entire construction of the second embodiment is substantially equal to that of the first embodiment. Therefore, the following description will be made centering on the construction of the second embodiment different from that of the first embodiment with reference to FIGS. 6*a* to 6*c*.

Referring to FIG. 6*a*, the bottom of the storage chamber 600 is provided with switches 700 projecting upward.

The switches 700 include a first switch 710 positioned on the front area with reference to the center of the storage chamber 600, and a second switch 720 positioned on the rear area, wherein the switches 710 and 720 are formed substantially in a rectangular shape and occupy most of the bottom of the storage chamber 600.

In addition, the first switch 710 is connected to the first lamp 340 in such a manner that the first switch 710 is lowered when a load is applied to the first switch, thereby connecting the power circuit of the first lamp 340 to the power source so that the first lamp 340 is turned on. If the load is released, the first switch 710 is returned to its original position, so that the first lamp 340 is turned off. Like this, the second switch 720 is connected to the second lamp 340' so as to perform the same function as the first switch.

Referring to FIG. 6*b*, the bottom of the storage chamber 600 is provided with switches 700 including a first pressure sensor 730 and a second pressure sensor on the front area and die rear area, respectively, with reference to the center of the storage chamber.

The first and second sensors 730 and 740 are connected with the power circuits of the lamps 340 and 340', respectively, so as to transmit a signal to the lamps 340 and 350, respectively, when a load is sensed by them, so that the lamps 340 and 340' are turned on. Unless a load is not sensed, no signal is transmitted so that the lamps are not turned on.

Referring to FIG. 6*c*, switches 700 include a first proximity sensor 750 is provided on the lower part of the front side wall of the storage chamber 600, and a second proximity sensor 760 is provided on the lower part of the rear side wall of the storage chamber 600.

The first and second proximity sensors 750 and 760 are connected to the power circuits of the lamps 340 and 340', respectively. The first and second proximity sensors 750 and 760 sense an object adjacent to the sensors, i.e. stored products B received in the storage chamber 600, and transmit a signal to the power circuits of the lamps 340 and 340', so that the lamps 340 and 340' are turned on.

Next, the first embodiment of a method of controlling the inventive illumination device for a refrigerator will be described.

Figure 8:
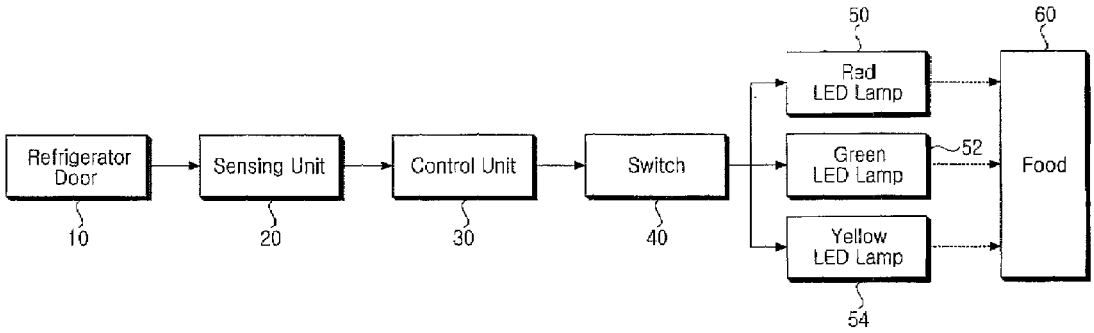
FIG. 8 is a block diagram showing a construction of the inventive refrigerator illumination device for describing a first embodiment of the inventive control method.
Figure 9:
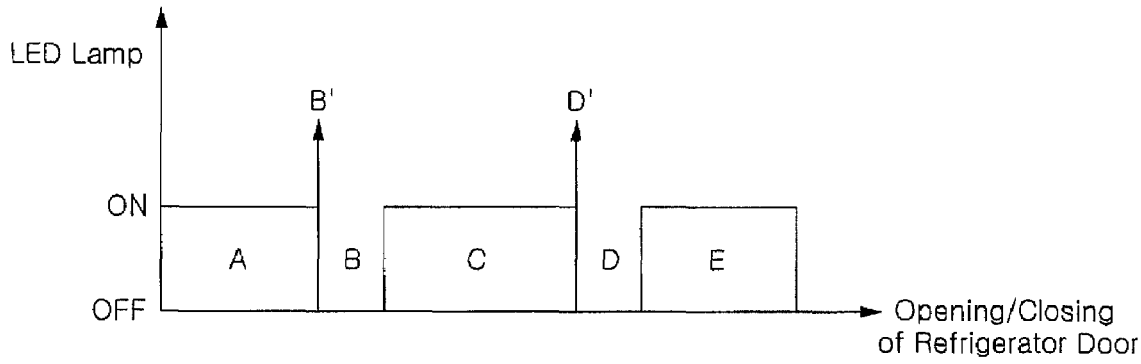
FIG. 9 is a timing chart showing the driving condition of the illumination device of FIG. 8 in terms of the opening and closing of a door.

FIG. 8 is a block diagram showing a construction of an illumination device for a refrigerator according to a first embodiment of the inventive control method, and FIG. 9 is a timing chart showing the driving condition of the illumination device of FIG. 8 in terms of the opening and closing of a door.

According to these drawings, one or more LED lamps 50, 52 and 54 are provided on a surface of the door so as to illuminate the food 60 stored in the storage chamber within the refrigerator when the refrigerator door 10 is not opened. The LED lamps 50, 52 and 54 irradiate different colors of light depending on the kind of the food 60. It is possible to a plurality of same colored LEDs depending on the volume of the storage chamber of the refrigerator. According to the present invention, a red LED lamp 50, a green LED lamp 52 and a yellow LED lamp 54, which are the most appropriate for maintaining the freshness of the food 60 depending on the kind of food 60, e.g. vegetable/fruit or kimchi, are correspondingly provided.

A sensing unit 20 is provided so as to sense the opening and closing of the door 10, and a switch 50 is also provided so as to intermittently activate the on/off driving of the LED lamps 50, 52 and 54 according to a sensing signal of the sensing unit 20. The switch 40 may control all of the LED lamps 50, 52 and 54. Alternatively, a plurality of switches may be provided for turning the LED lamps on or off, respectively, although not shown in the drawings.

In addition, a control unit 30 is also provided, which receives the sensing signal so as to perform on/off control of the switch 40. According to the control operation of the control unit 30, the switch 40 is opened or closed, wherein various switching device such as a physical switch, a relay, a transistor (TR), etc. that can be opened or closed according to a control signal can be applied as the switch 40.

In order to confirm whether the LED lamps 50, 52 and 54 are normally operated or not in the outside when the door 10 is closed, an operation indicating lamp (not shown) may be mounted at a predetermined place on an outer surface of the refrigerator. Any part may be selected as the mounting place if it can be easily confirmed by the user.

Next, the action of the first embodiment of the method of controlling the inventive illumination device for a refrigerator configured as described above will be described in more detail.

If the refrigerator is operated as power is applied to the refrigerator and the door 10 is not opened, the LED lamps 50, 52 and 54 provided inside of the door 10 are also operated in response to the operation of the refrigerator (A, C and E portions in FIG. 9). The operation of the LED lamps 50, 52 and 54 are executed when the switch 40 is turned on according to the control operation of the control unit 30.

If the LED lamps 50, 52 and 54, which are provided to correspond to the kind of the food 60 stored in the storage chamber, respectively, are operated, the freshness of the food 60 can be maintained by the light directly irradiated from the LED lamps 50, 52 and 54. Because the LED lamps 50, 52 and 54 irradiate different colors of light depending on the kind of food 60 as described above, the freshness of the food 60 can be most suitably maintained.

The refrigerator door is opened (time points B' and D' in FIG. 9). Then, the sensing unit 20 senses the opening of the door 10 and applies a sensing signal to the control unit 30. The control unit 30 renders the switch 40 connected to the LED lamps 50, 52 and 54 to be turned off according to the sensing signal.

If the power supply is interrupted as the switch 40 is turned off, the LED lamps 50, 52 and 54 are also turned off, whereby the irradiation of light is also interrupted (parts B and D in FIG. 9). That is, if the user opens the door 10, the sensing unit 20 senses it and interrupts the driving of the LED lamps 50. As a result, the light emitted from the LED lamps 50, 52 and 54 is prevented from being directly irradiated to the user's eyes.

In this case, because the switch 40 is connected to all of the LED lamps 50, 52 and 54, if the switch 40 is opened, all of the LED lamps 50, 52 and 54 are turned off. If the LED lamps 50, 52 and 54 are provided with switches, respectively, it is possible to selectively execute the on/off control of the LED lamps 50, 52 and 54. That is, an LED lamp provided at a position where it is difficult for the LED lamp to directly irradiate light to the user's eyes when the door 10 is opened may be allowed to be continuously operated. Preferably, because an LED lamp provided on or adjacent to a hinge unit interconnecting the door 10 and the main body may scarcely influence the user's eyes even if the door 10 is opened, such an LED lamp may be continuously activated.

According to the first embodiment described above, because the power applied to the LED lamps 50, 52 and 54 is interrupted if the door 10 is opened, so that light is not irradiated, it is possible to avoid a blinding light phenomenon.

Next, a second embodiment of the method of controlling the inventive illumination device for a refrigerator will be described.

Figure 10:
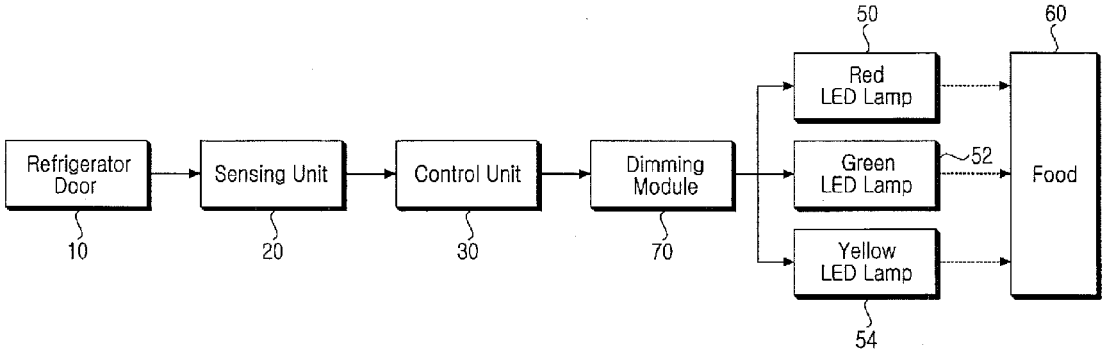
FIG. 10 is a block diagram showing a construction of the inventive refrigerator illumination device for describing a second embodiment of the inventive control method.
Figure 11:
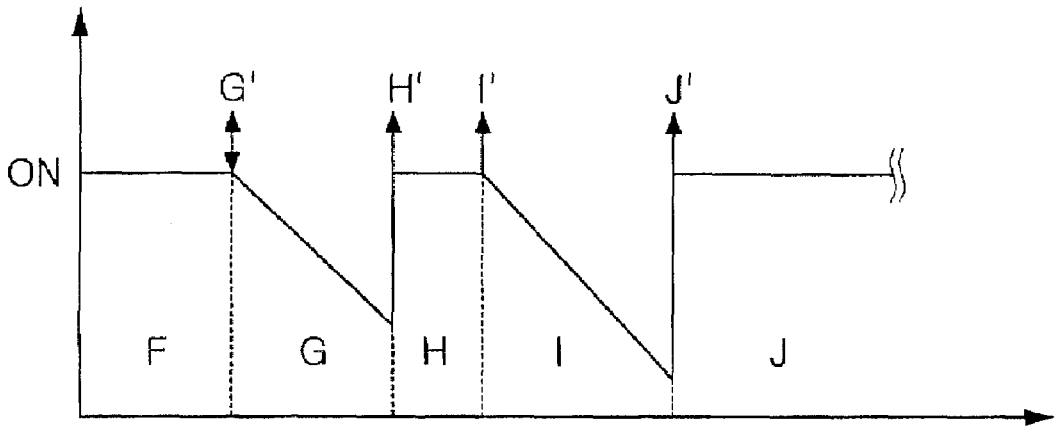
FIG. 11 is a timing chart showing the driving condition of the illumination device of FIG. 10 in terms of the opening and closing of the door.

FIG. 10 is a block diagram showing a construction of an illumination device for a refrigerator according to the second embodiment of the inventive control method, and FIG. 11 is a timing chart showing the driving condition of the illumination device of FIG. 10 in terms of the opening and closing of a door.

As shown in these drawings, a dimming module 70 is provided for gradually reducing the intensity of light of the LED lamps 50, 52 and 54 when the door 10 is opened. That is, instead of the switching means of the first embodiment, a dimming module 70 having a dimming circuit is provided. Such a dimming module 70 may be separately provided for each of the LED lamps 50, 52 and 54 so as to individually control the LED lamps 50, 52 and 54, or a single dimming module 70 may be provided for controlling the intensity of light of all of the LED lamps 50, 52 and 54, as in the first embodiment. Besides, it is also possible for each of the LED lamps 50, 52 and 54 to integrally have a dimming circuit, so that the intensity of light thereof can be adjusted.

The construction of a control unit 30 for controlling the intensity of the light of the LED lamps 50, 52 and 54 by controlling the dimming module or modules 70 according to a signal module of the sensing unit 20 for sensing the opening of the door 10 is similar to that of the first embodiment.

Next, the action of the second embodiment of the method of controlling the inventive illumination device for a refrigerator will be described in more detail.

As power is applied to the refrigerator, the function of the refrigerator is performed and the LED lamps 50, 52 and 54 provided on the inside of the door 10 to be in correspondence with the storage chamber(s) are also operated (parts F, H and J in FIG. 11). The LED lamps 50, 52 and 54 are normally operated when the door 10 is not opened. Therefore, the LED lamps 50, 52 and 54 provided to correspond to the tops of the food 60 stored in the storage chamber are operated, and the freshness of the food 60 can be maintained by the light directly irradiated from the LED lamps 50, 52 and 54.

The refrigerator door is opened (time points G' and I' in FIG. 11). Then, the sensing unit 20 senses the opening of the refrigerator door 8, and applies a sensing signal to the control unit 30. The control unit 30 renders the dimming module 70 to be turned on according to the sensing signal. If the dimming module 70 is turned on, the intensity of light of the LED lamps 50, 52 and 54 is gradually reduced. That is, when the door 10 is opened, the dimming module 70 reduces the power applied to the LED lamp 50, 52 and 54 according to the control operation of the control unit, thereby substantially adjusting the intensity of light. At this time, the parts G and I where the intensity of light is reduced decreases in proportion to the length of time period in which the door 10 is opened, and if the door 10 is continuously opened for a long time, the intensity may be gradually reduced and finally turned off. Of course, it is also possible to control the intensity of light not to be reduced below a predetermined level even if the door 10 is continuously opened.

Here, the dimming module 70 adjusts the intensity of light through various methods, e.g. by increasing the intensity of electric resistance at the time of sensing the opening of the door, thereby controlling the power supply.

Once the control is performed in such a way that the intensity of light is reduced by the dimming module 70 which operates according to the operation of the control unit simultaneously with the opening of the door 10, it is possible to avoid a blinding light phenomenon felt by the user.

If the door 10 is closed again (time points H' and J' in FIG. 11), the control unit 30 receives a sensing signal from the sensing unit 20 and supplies power again, thereby rendering the LED lamps 50, 52 and 54 to be normally turned on.

Here, as in the first embodiment, it is possible to provide a plurality of dimming modules 70 in proportion to the number of the LED lamps, and it is also possible to set the light intensity decrease rate of an LED lamp, which is provided at a position where it is difficult for the LED lamp to directly irradiate light to the user's eyes, to be smaller than that of any other LED lamp.

According to the second embodiment described above, it is possible to protect the user's eyes because the intensity of light of LED lamps is reduced even if the refrigerator door is opened.

Next, a third embodiment of the method of controlling the inventive illumination device for a refrigerator will be described.

If light, the illumination of which is higher than a predetermined level, is irradiated to food stored for a long time (kimchi, vegetable or fruit), acid degree is reduced (acidification is prevented), whereby the freshness retaining term can be extended. For example, if light of not less than 75 lx is irradiated for kimchi, vegetable or fruit, it is possible to extend the conventional cold-storage term by twice or more. If light of not less than 115 lx is irradiated during the fermentation of kimchi, it is also possible to extend the storage term of the kimchi.

It should be noted that according to the present invention, different colored lamps are provided, each of which has an inherent illumination value, and the lamps are selectively driven so as to irradiate light into the interior of the refrigerator.

Figure 12:
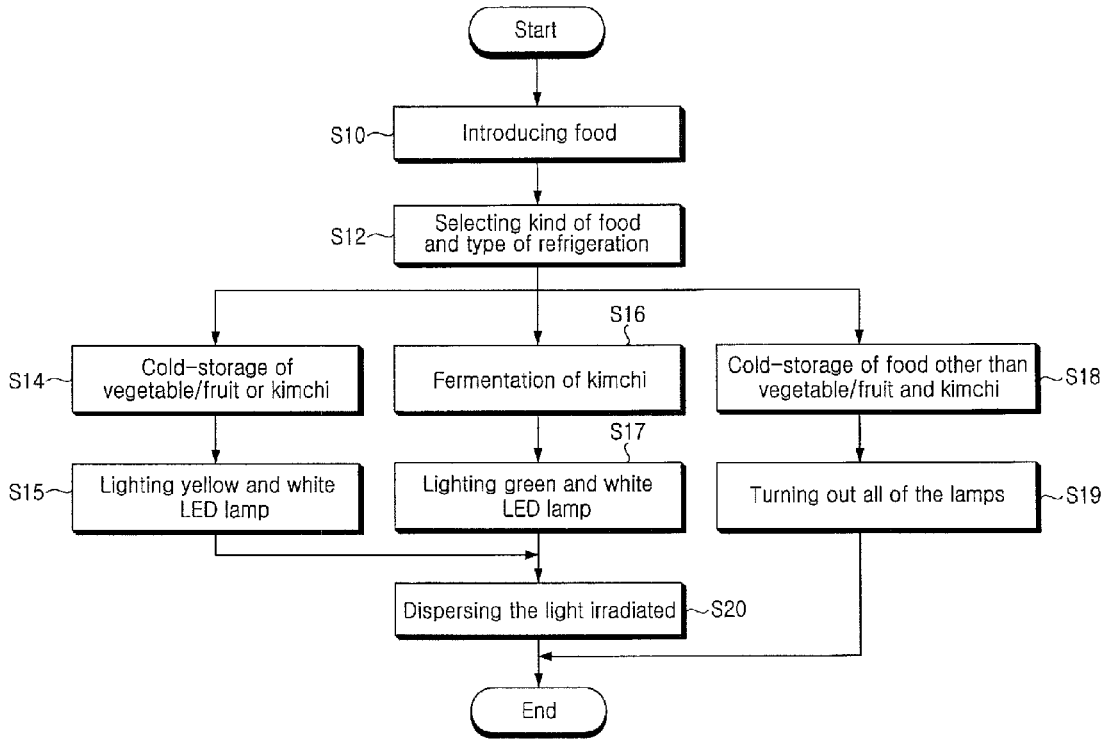
FIG. 12 is a flowchart showing a third embodiment of the inventive method of controlling the inventive illumination device step by step.
Figure 13:
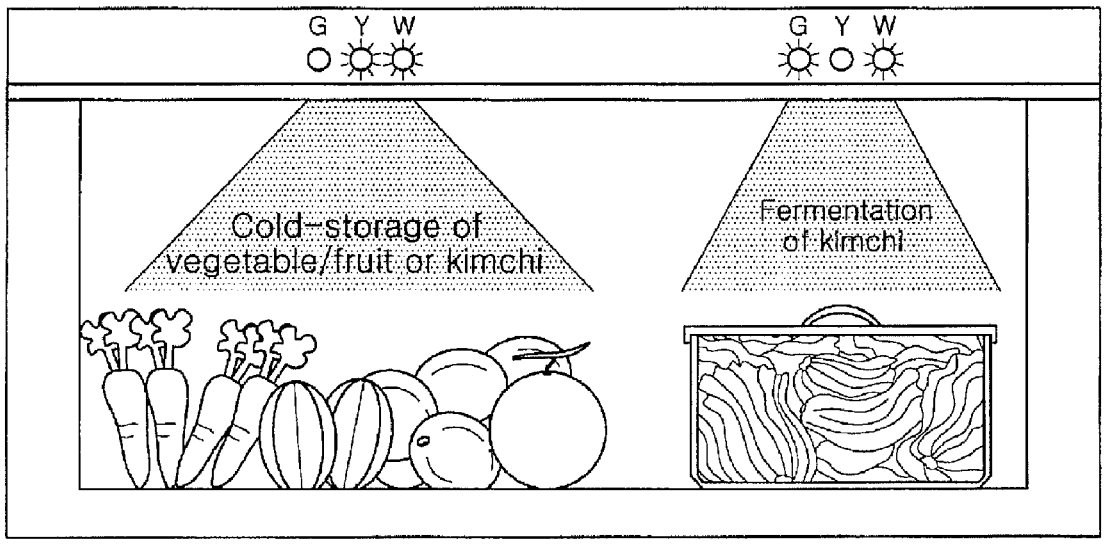
FIG. 13 exemplifies lamps lighted according to the control method shown in FIG. 12.

FIG. 12 is a flowchart showing the method of controlling the inventive illumination device according to a third embodiment of the inventive control method step by step, and FIG. 13 exemplifies lamps turned on according to the control method shown in FIG. 12.

According to these drawings, in step S10, food is introduced into the refrigerator. Next, in step S12, the control unit 30 is inputted with the kind of the introduced food and the type of refrigeration through the input and display unit 10 by the user. In the present embodiment, for the convenience of description, it is assumed that the introduced food is cold-storage required food.

In addition, if vegetable/fruit or kimchi is selected as the kind of food and the type of refrigeration in step S12, in step S14, the control unit 30 renders the switches connected to yellow and white LED lamps to be turned on, and renders the switch connected to the LED lamp to be turned off. By this, the yellow and white LED lamps are turned on as shown in FIG. 13. As a result, the vegetable/fruit or kimchi introduced into the refrigerator is illuminated by yellow light and white light so that the illumination within the refrigerator is maintained at 75 lx or more, step S15.

Whereas, if the fermentation of kimchi is selected in step S12, in step S16, the control unit 30 renders the switches connected to the green and yellow LED lamps to be ruined on, and renders the switch connected to the yellow LED lamp to be turned off. As a result, the green and white LED lamps are turned on as shown in FIG. 13. As a result, green light and white light are illuminated within the refrigerator so that the illumination within the refrigerator is maintained at 115 lx or more, in step S17.

In addition, the light irradiated from the LED lamps in step S15 and step S17 is reflected in various angles by the reflection plate, thereby being dispersed, in step S20.

Furthermore, in step S18, if it is determined that the food selected in step S12 is not such a kind of food, the freshness of which cannot be maintained by irradiating light, the control unit 30 renders all of the LED lamps to be turned off, in step S19. In such a case, it is preferred that the control unit 30 renders the LED lamps to be turned on only when the refrigerator door is opened, so that the LED lamps perform the illumination function.

Through the processes described above, the inventive lamp construction and lamp control device selectively render the lamps to be turned on depending on the kind of food introduced into the refrigerator and the type of refrigeration, so that light is irradiated, the illumination of which is equal to or higher than a predetermined level, and the light irradiated from the lamps are reflected in various angles, thereby being dispersed.

The inventive illumination device for a refrigerator and a method of controlling the same as described above have the following effects.

First, according to the present invention, because lamps are fitted in and anchored by a lamp mounting unit without using separate anchoring members, such as screws for anchoring lamps, the assembling process can be simplified and easily performed. In addition, it is possible to prevent the fracture of the substrate, which may occur by rotational torque when anchoring members are used.

In addition, the watertight cover prevents moisture or water from being directly penetrated into the lamps. Consequently, the fracture of lamps and user's electric shock can be prevented, which will increase the consumers' satisfaction for quality and recognition for the product.

Lamps are turned on or off depending on the positions of stored products stored within the storage chamber, it is possible to prevent lamps from being unnecessarily used, thereby enhancing efficiency in terms of energy and space. That is, as the efficiency in terms of space and energy is enhanced, the consumers' satisfaction and confidence for the product can be increased.

Furthermore, the visible rays radiated in combination from the illumination device controls the fermentation rate of kimchi, so that the kimchi can get mature early and maintain its good flavor desired by the user for a long time. As a result, the refrigerator's performance in fermentation and storage can be enhanced.

Next, because the user's eyes can be prevented from being directly illuminated by the LED lams at the time of opening the refrigerator door, it is possible to avoid or minimize the blinding light phenomenon to the user's eyes. In addition, because the LED lamps are turned off when the refrigerator door is opened, it is possible to reduce the power consumption of the refrigerator.

Furthermore, according to the present invention, different colored lamps are activated depending on the kind of food stored in the refrigerator and the type of the refrigerator, so that light can be irradiated to the food at a level higher than or equal to a predetermined level. As a result, the acidification of the food can be prevented, thereby maintaining the freshness of the food, so that the period for storing the food can be extended.

Although several preferred embodiments of the present invention have been disclosed for illustrative purposes, it should be understood that numerous modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a main body forming an external appearance of the refrigerator, the main body comprising a storage chamber that stores products in an interior thereof being opened through one side of the main body; a door that selectively shields an opening of the storage chamber; and an illumination device mounted on a bottom surface of the door, the illumination device comprising: a lamp assembly that irradiates light to an inside of a storage chamber of the refrigerator;

a base plate mounted on a side within the storage chamber, wherein the lamp assembly is provided on a side of the base plate;

a watertight cover formed to enclose the lamp assembly and block direct penetration of water into the lamp assembly; and at least one fastening device formed on a side of the base plate, wherein the at least one fastening device surrounds an outer surface and an inner surface of an entire lower edge of the watertight cover, such that the at least one fastening device and the watertight cover form a recess-prominence engagement that prevents the penetration of water into the lamp assembly, wherein the fastening device comprises:

a first rib that projects from a top surface of the base plate and extends along and entirely surrounds the outer surface of the lower edge of the watertight cover; and a second rib that projects from the top surface of the base plate and extends along and entirely surrounds the inner surface of the lower edge of the watertight cover, and wherein the lamp assembly comprises: a plurality of lamps that are differently oriented from each other and that irradiate light to the interior of the storage chamber; and a manipulation panel mounted on a side of the main body, the manipulation panel connected to a power circuit individually controlling the plurality of lamps.

2. The refrigerator as claimed in claim 1, wherein the top surface of the base plate further comprises a water discharge rib formed inside of the second rib so that moisture passing through the recess-prominence engagement is condensed on die water discharge rib.

3. The refrigerator as claimed in claim 2, wherein the water discharge rib is inwardly spaced from an inner side of the second rib and projects upward.

4. The refrigerator as claimed in claim 3 wherein the at least one fastening device includes at least one water discharge hole formed through the first rib and the second rib, and the watertight cover includes at least one water discharge opening corresponding to the at least one water discharge hole in position and shape, so that the moisture within the lamp assembly is guided to an outside of the lamp assembly.

5. The refrigerator as claimed in claim 1, wherein the lamp assembly comprises:

the plurality of lamps;

a lamp mounting device provided on the side of the base plate, wherein the plurality of lamps is fitted into the lamp mounting device from a rear side to a front side of the lamp mounting device so that the plurality of lamps is located at a predetermined position;

a reflection plate mounted on a side of the lamp mounting device that reflects light emitted from the plurality of lamps; and a lamp cover that covers the lamp mounting device and is coupled to the lamp mounting device.

6. The refrigerator as claimed in claim 5, wherein the plurality of lamps comprises:

a substrate provided with a light emitting circuit; and a plurality of light emitting diodes mounted on the substrate, the plurality of light emitting diodes emitting light according to an electric signal transmitted through the light emitting circuit.

7. The refrigerator as claimed in claim 6, wherein the lamp mounting device comprises:

the base plate forming a bottom of the lamp mounting device;

a diode holder provided on the side of the base plate, the diode holder provided with a plurality of openings corresponding to each of the plurality of light emitting diodes in size, respectively, thereby providing a plurality of light emitting diode inserting spaces; and a front guide projection that projects upward from a rear side of the diode holder so as to determine the front insertion position of the at least one lamp.

8. The refrigerator as claimed in claim 7, wherein a height of the front guide projection is lower than a mounting height of the plurality of light emitting diodes so that the front guide projection is in touch with the substrate and is not in touch with the plurality of light emitting diodes.

9. The refrigerator as claimed in claim 5, wherein the reflection plate is formed in a stair-like shape on a top surface of the base plate, wherein a height of the stair-like shape increases toward a front end thereof, and wherein each surface between two adjacent steps is inclined to be oriented forwardly upward.

10. The refrigerator as claimed in claim 9, wherein the lamp cover is partially formed from a transparent material allowing light irradiated from the at least one lamp to be transmitted into the storage chamber, wherein the lamp cover includes fixing ribs that fix the lamp cover, and wherein each of the fixing ribs projects downward from an inner surface of the lamp cover.

11. The refrigerator as claimed in claim 10, wherein the fixing ribs comprise:

a front fixing rib formed behind a diode holder so as to prevent forward insertion of the plurality of lamps beyond a predetermined position; and a rear fixing rib formed at a position spaced by a thickness of a substrate from the front fixing rib so as to prevent the plurality of lamps from releasing backward.

12. The refrigerator as claimed in claim 1, the refrigerator comprising a storage chamber having a reflection layer coated on an inner surface thereof that reflects visible rays irradiated from the lamp assembly.

13. The refrigerator as claimed in claim 1, wherein the door that selectively shields the storage chamber further comprises a door reflection layer on an inner surface thereof that reflects visible rays irradiated from the illumination device, the door reflection layer being formed by coating a light-reflective material.

14. The refrigerator as claimed in claim 1, wherein the plurality of lamps are mounted to-he-oppositely oriented with reference to a center of the lamp assembly.

15. The refrigerator as claimed in claim 14, wherein the plurality of lamps comprise:

a first lamp mounted to be oriented toward a front side of the storage chamber; and a second lamp mounted to be oriented toward a rear side of the storage chamber.

16. The refrigerator as claimed in claim 15, wherein the manipulation panel comprises a plurality of buttons corresponding to the plurality of lamps, respectively, to individually control the plurality of lamps.

17. The refrigerator as claimed in claim 16, wherein the plurality of buttons comprise:

a first button connected to a power circuit for the first lamp to control lighting of the fast lamp; and a second button connected to a power circuit for the second lamp to control lighting of the second lamp.

18. The refrigerator as claimed in claim 17, wherein each of the first button and the second button is a push button that renders a corresponding lamp to be turned on when it is pressed an odd number of times, and renders the corresponding lamp to be turned off when it is pressed an even number of times.

* * * * *